US012590730B2

(12) United States Patent
Juliano et al.

(10) Patent No.: US 12,590,730 B2
(45) Date of Patent: Mar. 31, 2026

(54) ELECTRIC HEATER SYSTEM

(71) Applicant: Watlow Electric Manufacturing Company, St. Louis, MO (US)

(72) Inventors: Rolando Juliano, Vista, CA (US); Ni-ñen Paderayon, Cebu (PH); Dyson Cabahug, Cebu (PH); Rhea A. Del Campo, Cebu (PH); Melannie Nellas, Cebu (PH)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 868 days.

(21) Appl. No.: 17/841,986

(22) Filed: Jun. 16, 2022

(65) Prior Publication Data

US 2022/0404067 A1 Dec. 22, 2022

Related U.S. Application Data

(60) Provisional application No. 63/211,105, filed on Jun. 16, 2021.

(51) Int. Cl.

| | |
|---|---|
| ***F24H 9/00*** | (2022.01) |
| ***F24H 3/04*** | (2022.01) |
| ***F28D 7/16*** | (2006.01) |

(52) U.S. Cl.

CPC ..... *F24H 9/0057* (2013.01); *F24H 3/0405* (2013.01); *F28D 7/163* (2013.01); *F24H 2250/02* (2013.01)

(58) Field of Classification Search

CPC ..... F24H 1/105; F24H 3/0405; F24H 9/0015; F24H 9/0052; F24H 9/0057; F24H 9/0073; F28D 7/163

See application file for complete search history.

(56) References Cited

U.S. PATENT DOCUMENTS

| | | | | |
|---|---|---|---|---|
| 10,619,888 | B2 * | 4/2020 | Everly | H05B 3/82 |
| 2010/0170452 | A1 * | 7/2010 | Ford | F24H 9/0036 122/18.1 |

(Continued)

FOREIGN PATENT DOCUMENTS

| | | | |
|---|---|---|---|
| CN | 107791788 | A | 3/2018 |
| CN | 112781221 | A | 5/2021 |

(Continued)

OTHER PUBLICATIONS

International Search Report and Written Opinion issued in corresponding International Application No. PCT/US2022/033764, mailed Sep. 30, 2022, 11 pages.

(Continued)

*Primary Examiner* — Brian W Jennison

(74) *Attorney, Agent, or Firm* — Burris Law, PLLC

(57) ABSTRACT

An electric heater system includes an inlet, an outlet, a plurality of heat exchanger assemblies, and one or more connectors. The plurality of heat exchanger assemblies are connected in series. Each heat exchanger assembly includes a vessel, heating elements disposed within the vessel, and a fluid guide member. The connectors secure the vessels of the plurality of heat exchanger assemblies to each other. The connectors are also in fluid communication with the vessels. Fluid entering the inlet flows through the heat exchanger assemblies and through one or more connectors where it exits the outlet. The fluid guide members of the heat exchanger assemblies are of different or the same combinations to generate a predetermined pressure drop between the inlet and the outlet.

18 Claims, 17 Drawing Sheets

(56) References Cited

U.S. PATENT DOCUMENTS

| | | | | |
|---|---|---|---|---|
| 2012/0192813 | A1* | 8/2012 | Evans | F24H 15/215<br>122/20 B |
| 2014/0374408 | A1* | 12/2014 | Seewald | F24H 9/1818<br>219/628 |
| 2017/0254565 | A1* | 9/2017 | Everly | H05B 3/82 |

FOREIGN PATENT DOCUMENTS

| | | | |
|---|---|---|---|
| GB | 2265445 | A | 9/1993 |
| KR | 101692350 | A | 1/2017 |
| KR | 102184012 | B1 | 12/2020 |
| TW | 201731339 | A | 9/2017 |

OTHER PUBLICATIONS

Search Report issued in corresponding TW Application No. 111122499, dated May 17, 2023, 1 page.

* cited by examiner

ELECTRIC HEATER SYSTEM

CROSS-REFERENCE TO RELATED APPLICATION

This application claims priority to and the benefit of U.S. Provisional Patent Application No. 63/211,105, filed Jun. 16, 2021. The disclosure of the above application is incorporated herein by reference in its entirety.

FIELD

The present disclosure relates to an electric heater system, and more particularly to the arrangement of electrical heaters and related support structures within heat exchangers.

BACKGROUND

The statements in this section merely provide background information related to the present disclosure and may not constitute prior art.

The oil and gas industry has been taking major steps to reduce carbon emissions in light of recent regulations. One of the ways identified to achieve a low-carbon future is by converting gas fired heat exchangers to direct electric heat exchangers. However, conventional direct electric heat exchangers have a disadvantage of not being able to achieve the desired vaporization at specific temperature and outlet pressure and/or pressure drop. Furthermore, conventional direct electric heat exchangers are not able to produce the desired velocity and annular flow regime of a two-phase mixture.

These issues related to the implementation of electric heat exchangers, among other issues related to heat exchangers, are addressed by the present disclosure.

SUMMARY

This section provides a general summary of the disclosure and is not a comprehensive disclosure of its full scope or all of its features.

In one form, the present disclosure provides an electric heater system comprising an inlet, an outlet, a plurality of heat exchanger assemblies, and one or more connectors. The plurality of heat exchanger assemblies are connected in series. Each heat exchanger assembly comprises a vessel, heating elements disposed within the vessel, and at least one fluid guide member. The connectors secure the vessels of the plurality of heat exchanger assemblies to each other and are also in fluid communication with the vessels. Fluid entering the inlet flows through the heat exchanger assemblies and through the one or more connectors and exits through the outlet. The fluid guide members of the heat exchanger assemblies being of different combinations to generate a predetermined pressure drop between the inlet and the outlet.

In variations of this electric heater system, which may be implemented individually or in any combination: a first heat exchanger assembly of the plurality of heat exchanger assemblies includes a first fluid guide member and an adjacent second heat exchanger assembly of the plurality of heat exchanger assemblies includes a second fluid guide member, the first fluid guide member comprises a helical-shaped baffle and the second fluid guide member comprises single segmented baffles; a first heat exchanger assembly of the plurality of heat exchanger assemblies includes a first fluid guide member, a second heat exchanger assembly of the plurality of heat exchangers assemblies includes a second fluid guide member, and a third heat exchanger assembly of the plurality of heat exchanger assemblies includes a third fluid guide member, the first and second heat exchanger assemblies are adjacent to each other and two of the first, second, and third fluid guide members are of a same type; an insulating shroud surrounds the plurality of heat exchanger assemblies and the connectors; each heat exchanger assembly includes a heated section and a non-heated section, the heating elements are disposed within the heated section and the non-heated section is disposed between the heated section and an electrical enclosure; each heat exchanger assembly includes an electrical component configured to operate the heating elements, at least two of the electrical components have different operating voltages; a single electrical component is configured to operate all the heating elements of the plurality of heat exchanger assemblies at a same operating voltage; the connectors are straight or bent; the predetermined pressure drop is equal to or greater than 30%; a first heat exchanger assembly of the plurality of heat exchanger assemblies includes a first fluid guide member and an adjacent second heat exchanger assembly of the plurality of heat exchanger assemblies includes a second fluid guide member, the first and second fluid guide members comprise single segmented baffles; each heat exchanger assembly in a first row includes a first electrical component configured to operate the heating elements, each heat exchanger assembly in a second row includes a second electrical component configured to operate the heating elements, and each heat exchanger assembly in a third row includes a third electrical component configured to operate the heating elements, the first, second and third electrical components have different operating voltages.

In another form, the present disclosure provides an electric heater system comprising an inlet, an outlet, a plurality of heat exchanger assemblies, a plurality of electrical components and one or more connectors. The plurality of heat exchanger assemblies are connected in series. Each heat exchanger assembly comprises a vessel, heating elements disposed within the vessel, and at least one fluid guide member. The plurality of electrical components are configured to operate the heating elements of the plurality of heat exchanger assemblies. The connectors secure the vessels of the plurality of heat exchanger assemblies to each other. The connectors are also in fluid communication with the vessels. Fluid entering the inlet flows through the heat exchanger assemblies and through the connectors and exits through the outlet. The fluid guide members of the heat exchanger assemblies are of different combinations to generate a predetermined pressure drop between the inlet and the outlet. A first heat exchanger assembly of the plurality of heat exchanger assemblies includes a first fluid guide member and an adjacent second heat exchanger assembly of the plurality of heat exchanger assemblies includes a second fluid guide member. The first and second fluid guide members are of different types.

In yet another form, the present disclosure provides an electric heater system comprising an inlet, an outlet, a plurality of heat exchanger assemblies, one or more connectors and an insulating shroud. The plurality of heat exchanger assemblies are connected in series. Each heat exchanger assembly comprises a vessel, heating elements disposed within the vessel, and at least one fluid guide member. The connectors secure the vessels of the plurality of heat exchanger assemblies to each other. The connectors are also in fluid communication with the vessels. The insulating shroud surrounds the heat exchanger assemblies and the connectors. Fluid entering the inlet flows through the heat exchanger assemblies and through the connectors and exits through the outlet. The fluid guide members of the heat exchanger assemblies are of different combinations to generate a predetermined pressure drop between the inlet and the outlet. A first heat exchanger assembly of the plurality of heat exchanger assemblies includes a first fluid guide member and an adjacent second heat exchanger assembly of the plurality of heat exchanger assemblies includes a second fluid guide member. The first and second fluid guide members are of different types. Each heat exchanger assembly includes an electrical component configured to operate the heating elements. At least two of the electrical components have different operating voltages.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
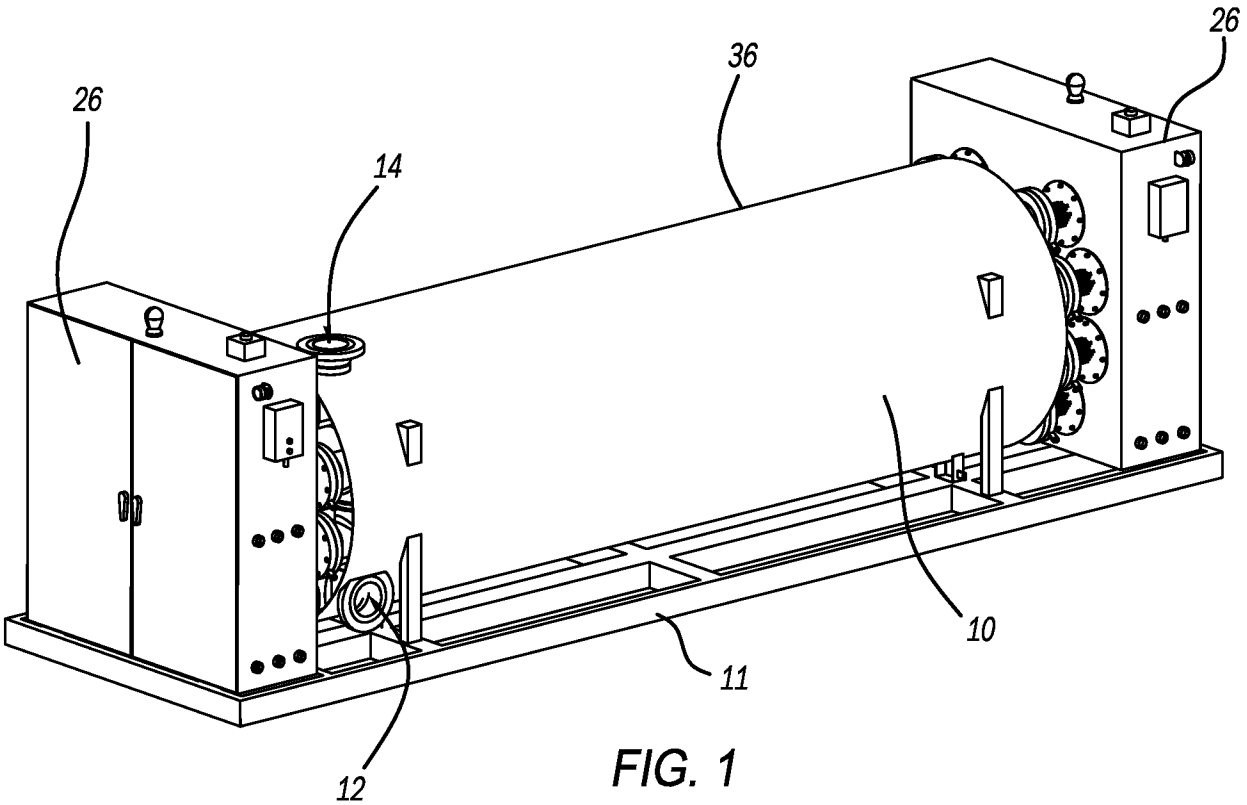
FIG. 1 is a perspective view of an electric heater system according to the principles of the present disclosure.
Figure 2:
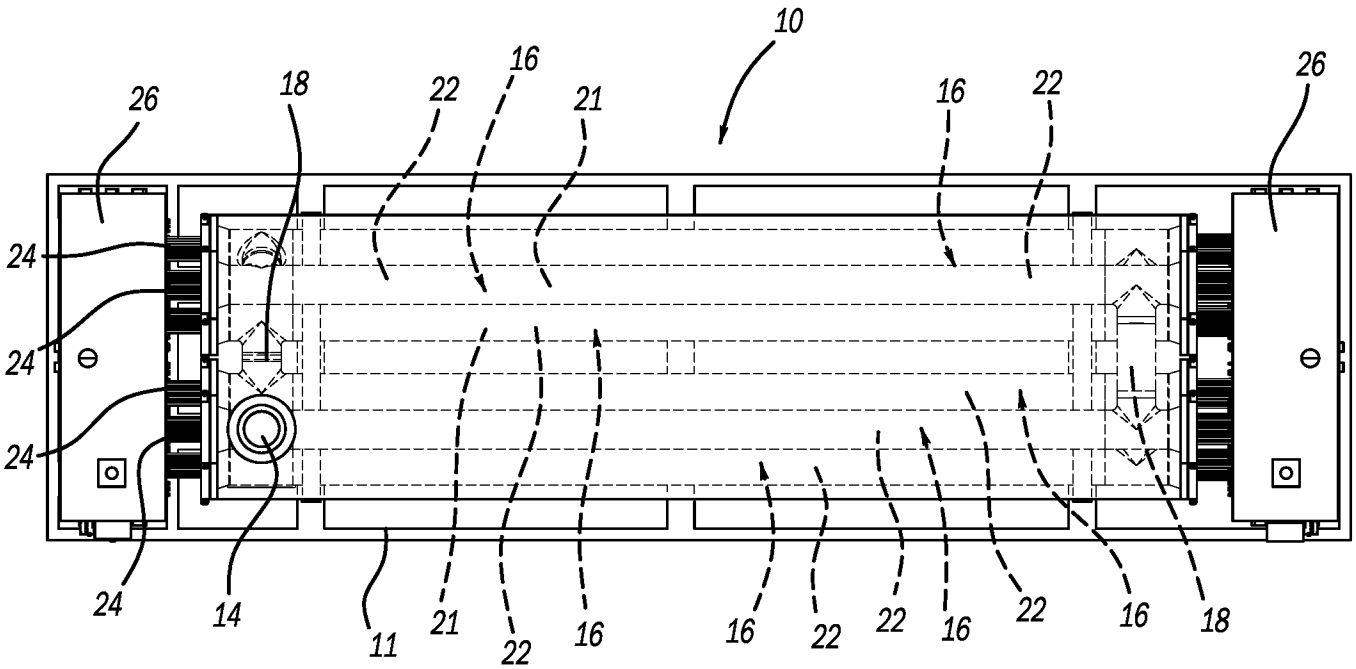
FIG. 2 is a top view of the electric heater system of FIG. 1.
Figure 3:
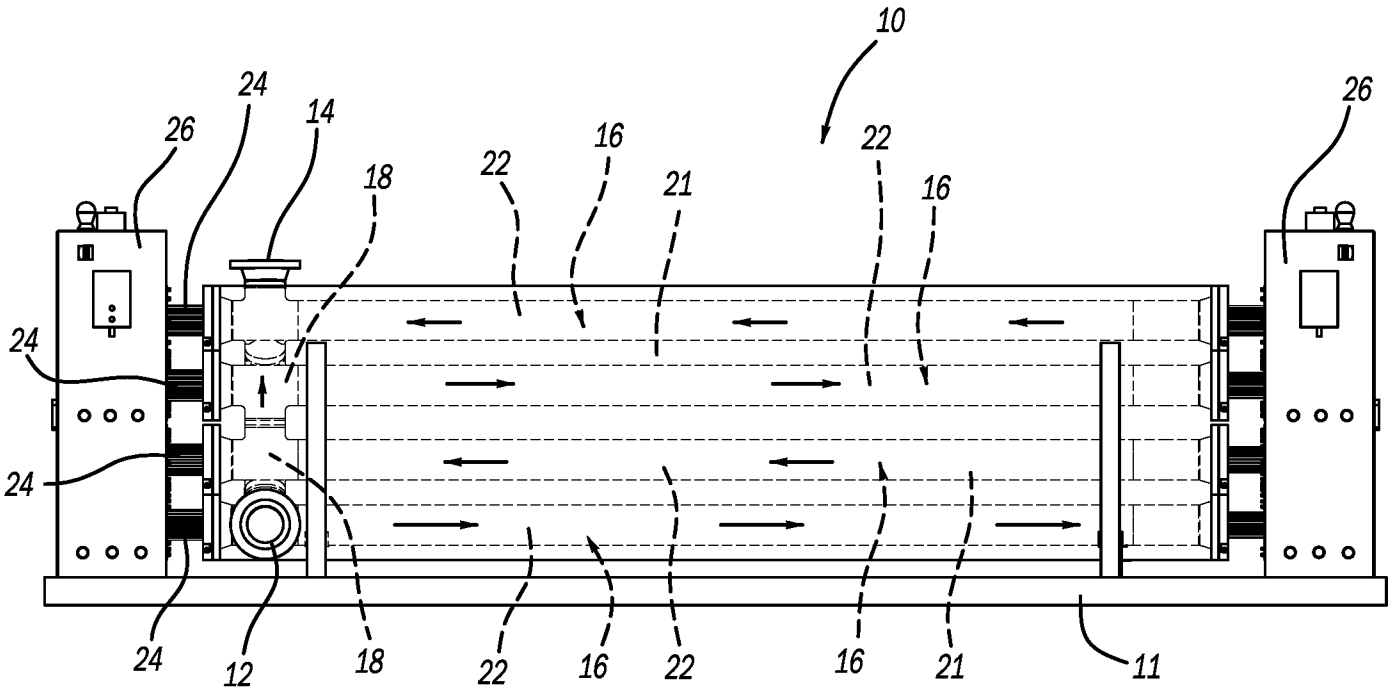
FIG. 3 is a side view of the electric heater system of FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIGS. 1-8, one form of an electric heater system according to the teachings of the present disclosure is illustrated and generally indicated by reference numeral 10. The electric heater system 10 may be secured to and supported by a base 11 and includes an inlet 12, an outlet 14, a plurality of heat exchanger assemblies 16, and a plurality of connectors 18. The inlet 12 is in fluid communication with one of the heat exchanger assemblies 16 of the plurality of heat exchanger assemblies 16 and the outlet 14 is also in fluid communication with one of the heat exchanger assemblies 16 of the plurality of heat exchanger assemblies 16. In one example, the inlet 12 may be in fluid communication with one of the heat exchanger assemblies 16 located near or at the bottom of the electric heater system 10 and the outlet 14 may be in fluid communication with one of the heat exchanger assemblies 16 located near or at the top of the electric heater system 10. Fluid entering the inlet 12 flows through the plurality of heat exchanger assemblies 16 and the plurality of connectors 18 and then subsequently exits through the outlet 14. The fluid has a predetermined pressure drop between the inlet 12 and the outlet 14. The predetermined pressure drop of the fluid may be equal to or greater than 30%. This produces a two-phase mixture in an annular flow regime and improves vaporization at a process fluid temperature. In some examples, the predetermined pressure drop of the fluid from the inlet 12 to the outlet 14 may be less than 30%.

Figure 4:
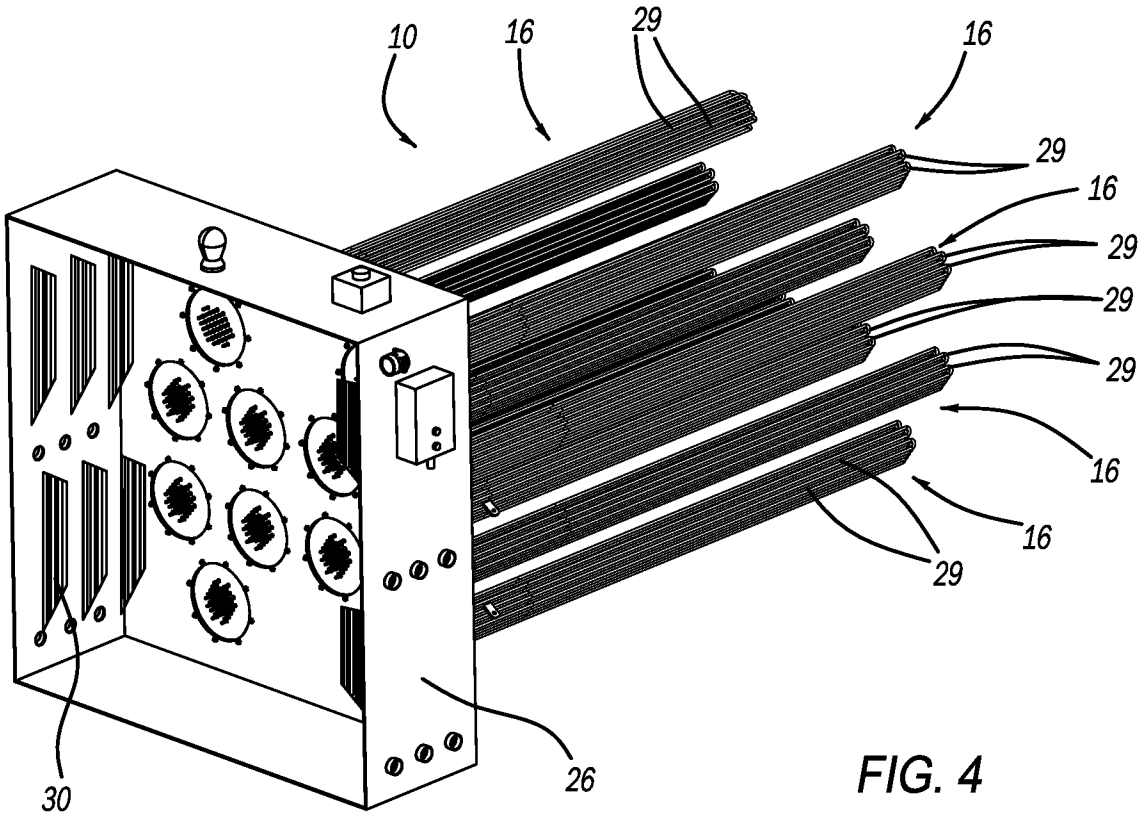
FIG. 4 is a perspective view of heat exchanger assemblies of the electric heater system of FIG. 1 with vessels of the heat exchanger assemblies removed for clarity.
Figure 5:
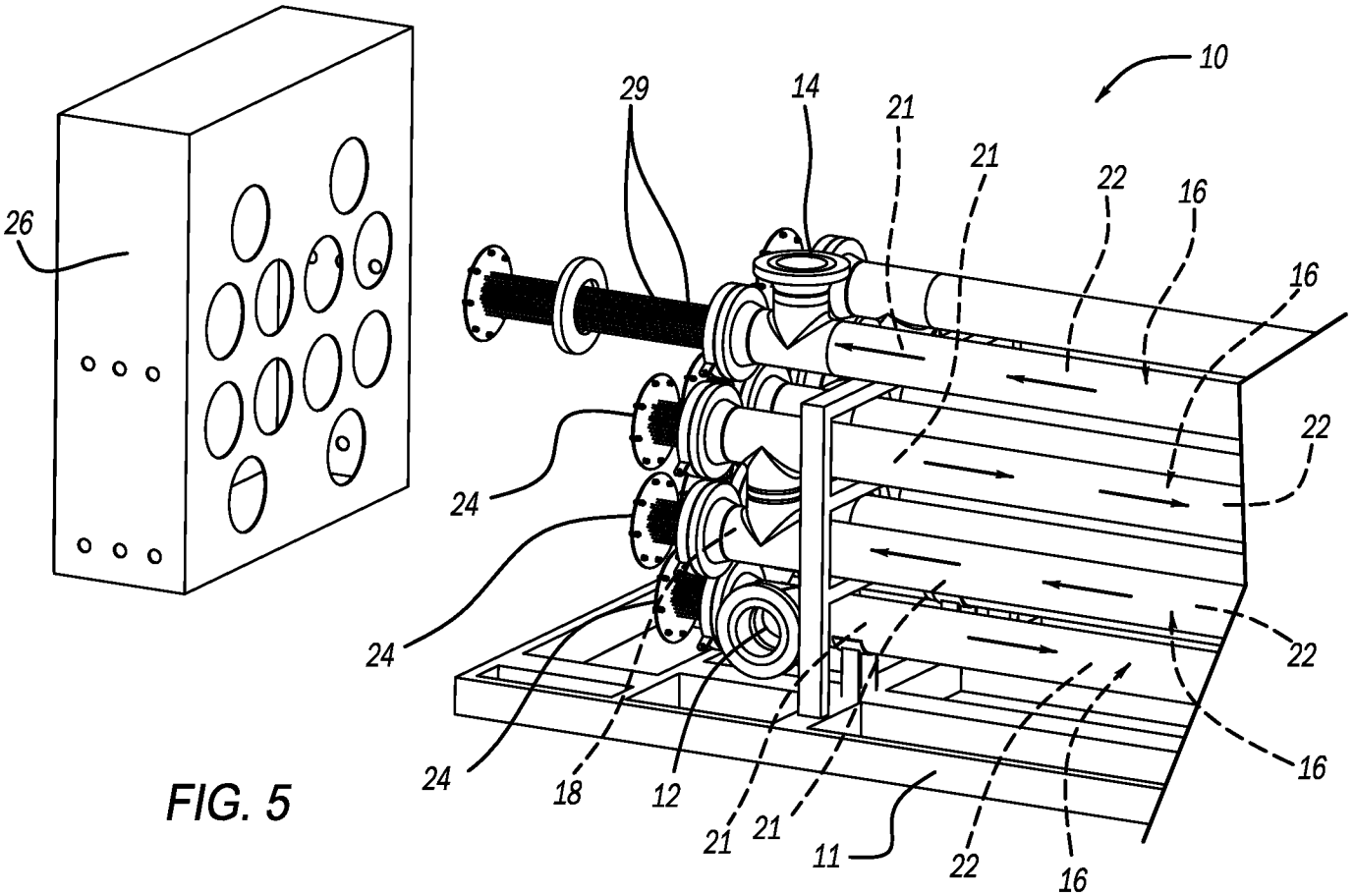
FIG. 5 is a partial perspective view of a portion of the electric heater system of FIG. 1 with resistive heaters of one heat exchanger assembly being removed from a vessel of the heat exchanger assembly.
Figure 6:
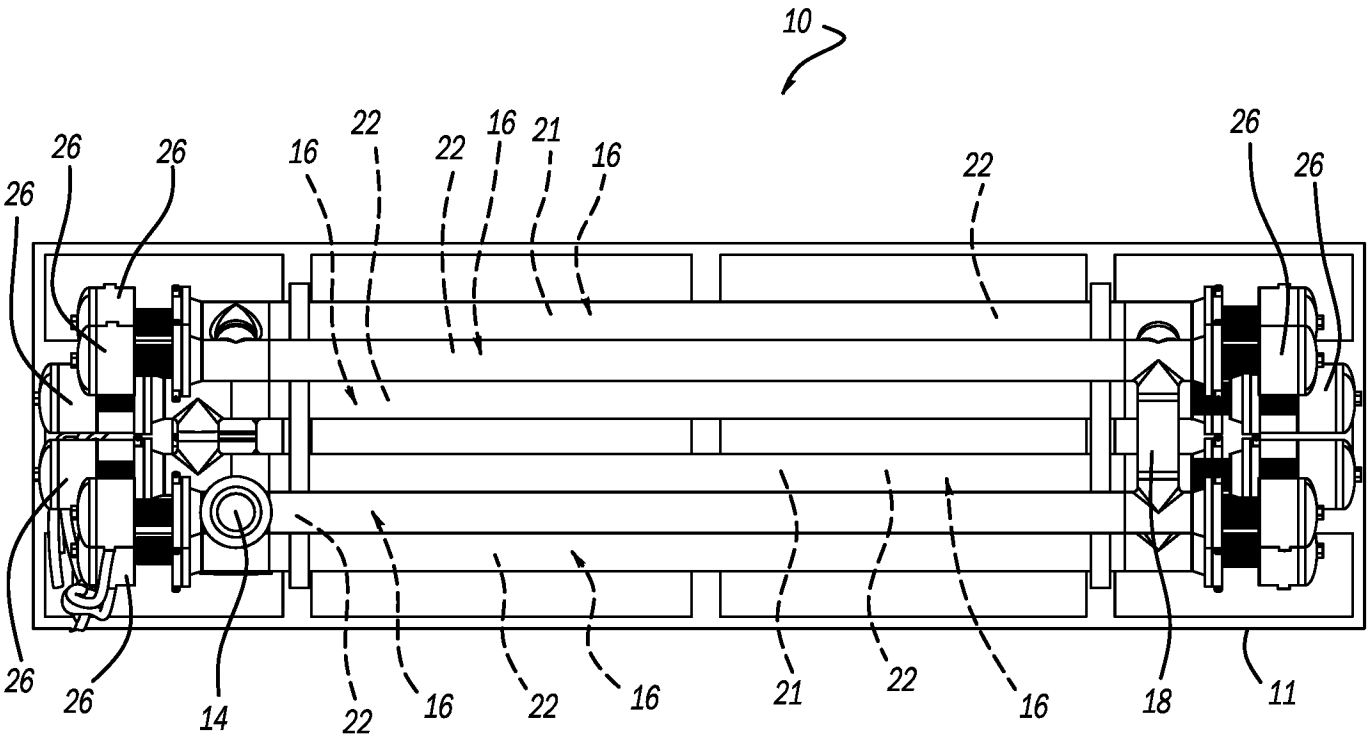
FIG. 6 is a top view of the electric heater system of FIG. 1 with a different type of enclosures.
Figure 7:
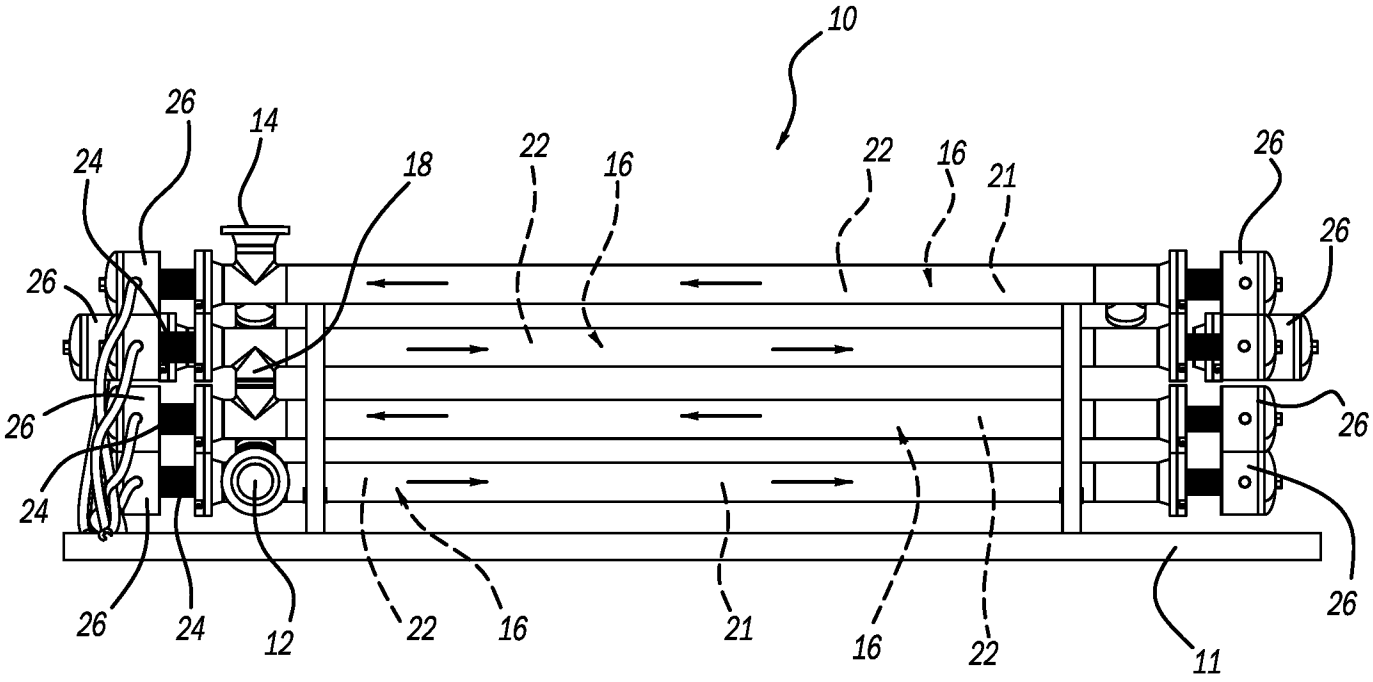
FIG. 7 is a side view of the electric heater system of FIG. 1 with a different type of enclosures.
Figure 8:
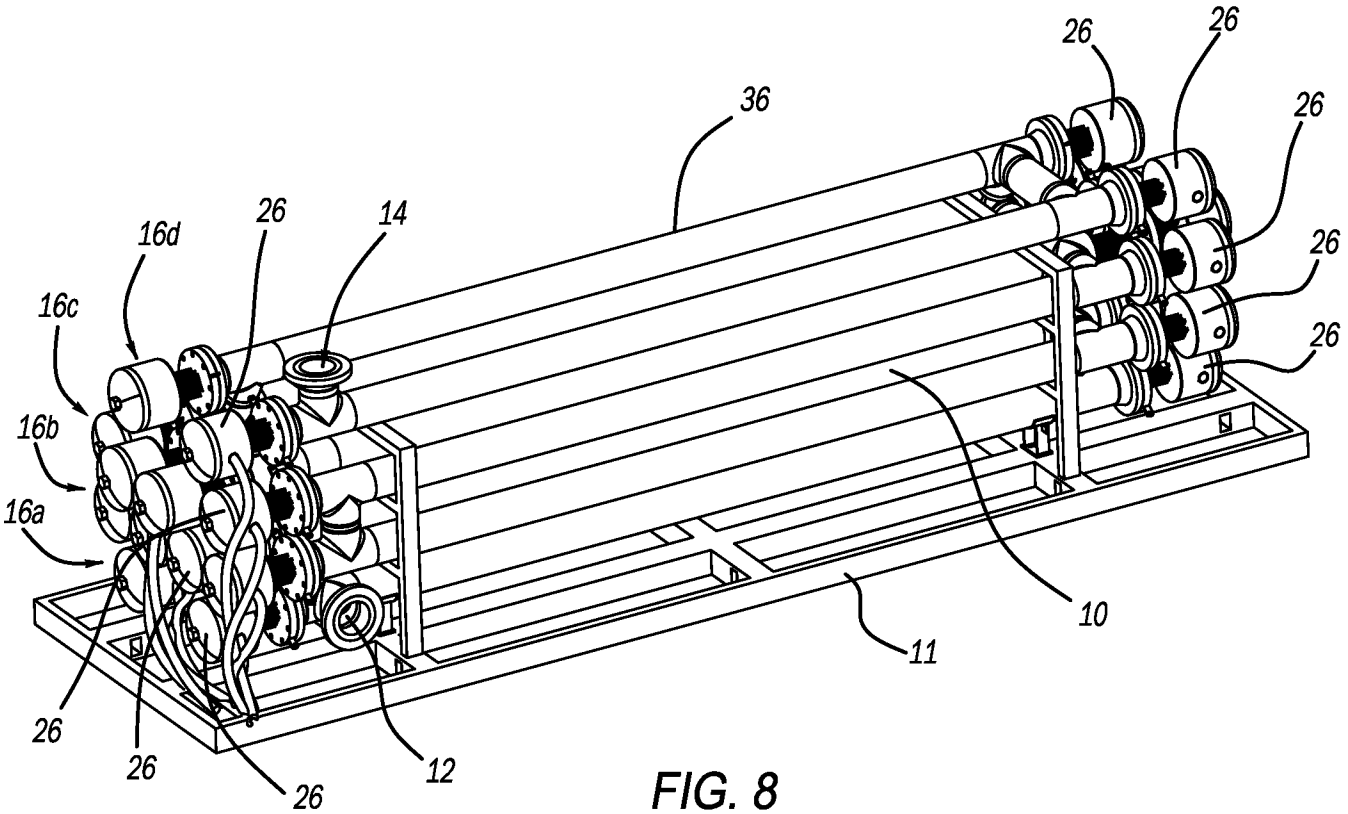
FIG. 8 is a perspective view of the electric heater system of FIG. 1 with a different type of enclosures.
Figure 9:
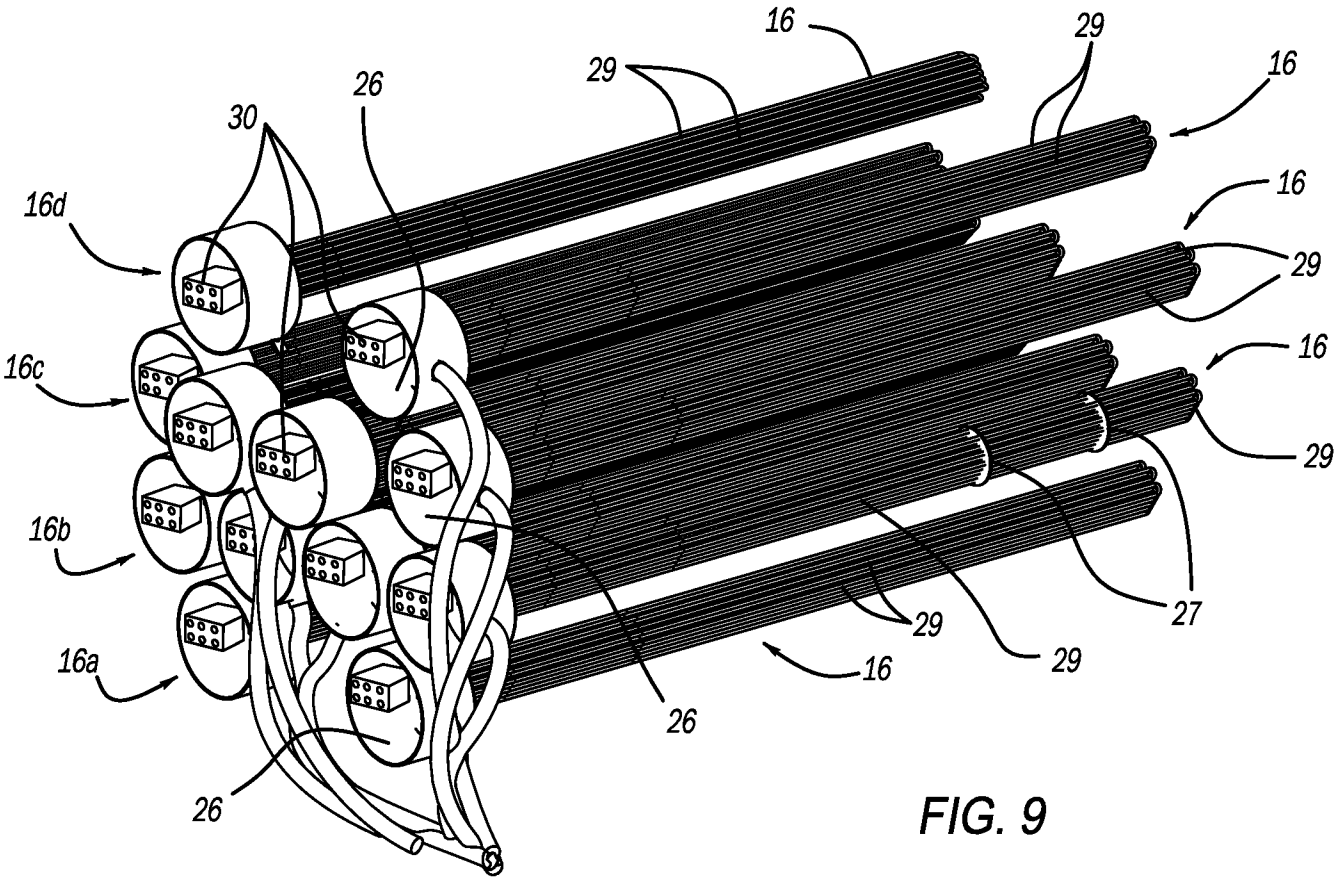
FIG. 9 is a perspective view of heat exchanger assemblies of the electric heater system of FIG. 8 with vessels of the heat exchanger assemblies removed for clarity.

With additional reference to FIG. 9, the heat exchanger assemblies 16 extend parallel to a longitudinal direction of the electric heater system 10 and are connected to each other in electrical and fluid series. Each heat exchanger assembly 16 includes a vessel 21 and a heater bundle having a heated section 22, a standoff assembly or non-heated section 24, an electrical enclosure 26, and a fluid guide member 27 (FIGS. 4 and 9). The vessel 21 is located within the heated section 22 and houses the fluid guide member 27. The heated section 22 includes a plurality of resistive heaters 29 extending in the longitudinal direction of the electric heater system 10 between the standoff assembly 24 and a terminal enclosure. The plurality of resistive heaters 29 are thus also disposed within the vessel 21. Each resistive heater 29 comprises at least one resistive heating element (not shown) with an electrical termination portion (not shown), insulation material (not shown), and an outer sheath. The insulation material surrounds the heating element and a portion of the electrical termination section. The outer sheath houses the heating element, the insulation material, and a portion of the electrical termination portion. Fluid entering the inlet 12 flows across the resistive heaters 29 in the vessels 21 and through the connectors 18 where it exits the outlet 14. The resistive heaters 29 may be one of a tubular heater, a cartridge heater, a multi-cell heater, or any heater construction with a configuration to provide heating of the fluid within the heated section 22 of the heat exchanger assembly 16.

As shown best in FIGS. 2, 3, 5, and 7, the standoff assembly 24 is positioned between and secured to the electrical enclosure 26 and the vessels 21 located at the heated section 22. The standoff assembly 24 is a non-heated section and generally provides a termination area to connect the resistive heaters 29 disposed within the vessel 21 to a power supply (not shown). The standoff assembly 24 shown in the figures is separate from and thus not disposed within a vessel.

The electrical enclosure 26 (FIGS. 1-6) houses electrical components 30 (FIGS. 4 and 9) that are configured to operate the heating elements of a respective heat exchanger assembly 16. As shown best in FIGS. 8 and 9, the heat exchanger assemblies 16 include a first row 16*a* of heat exchanger assemblies 16, a second row 16*b* of heat exchanger assemblies 16, a third row 16*c* of heat exchanger assemblies 16, and a fourth row 16*d* of heat exchanger assemblies 16, wherein each row is stacked vertically in this configuration. Each heat exchanger assembly 16 in the first row 16*a* includes a respective electrical component 30 configured to operate the heating elements of the heat exchanger assembly 16. Each heat exchanger assembly 16 in the second row 16*b* includes a respective electrical component 30 configured to operate the heating elements of the heat exchanger assembly 16. Each heat exchanger assembly 16 in the third row 16*c* includes a respective electrical component 30 configured to operate the heating elements of the heat exchanger assembly 16. Each heat exchanger assembly 16 in the fourth row 16*d* includes a respective electrical component 30 configured to operate the heating elements of the heat exchanger assembly 16. In one form, the heat exchanger assembly 16 operates with different voltages while the electrical components 30 of each row 16*a*, 16*b*, 16*c*, 16*d* operate at the same voltage. However, it is contemplated that the electrical components 30 of each row 16*a*, 16*b*, 16*c*, 16*d* may have different operating voltages. For example, the electrical components 30 of the heat exchanger assemblies 16 of row 16*b* may have higher operating voltages relative to the electrical components 30 of the heat exchanger assemblies 16 of row 16*a*. In another example, the electrical components 30 of the heat exchanger assemblies 16 of row 16*d* may have higher operating voltage relative to the electrical components 30 of the heat exchanger assemblies 16 of rows 16*b*, 16*c*. In some examples, a single electrical component will be configured to operate the heating elements of all the heat exchanger assemblies 16 of the rows 16*a*, 16*b*, 16*c*, 16*d* at the same operating voltage. The heat exchanger assemblies 16 may operate at low voltage (e.g., around 700V) or medium voltage (e.g., around 6,600V though other medium voltage configurations can be used such as between 2,000V and 20,000V).

With reference to FIGS. 4 and 9, the fluid guide member 27 is disposed within the vessel 21 and may also act as a support member to support the plurality of resistive heaters 29 relative to each other and relative to the vessel 21. The fluid guide member 27 may be one or more baffles that direct the flow of the fluid along a flow pathway between an inlet and outlet of the vessel 21. In one example, the fluid guide member 27 may be a single continuous helical shape baffle that defines a helical flow pathway. For example, the helical shape baffle may be similar to that shown and described in U.S. Publication No. 2019/0063853, which is commonly owned with the present application and the entire disclosure of which is incorporated herein by reference. The single continuous helical shape baffle may include helical members defining a variable pitch. The pitch of the helical members may be properly selected depending on a desired flow rate, a desired flow volume of fluid, a desired heat output, and a desired efficiency, for example, through the flow pathway of the respective heat exchanger assembly 16.

In another example, the fluid guide member 27 may be single segmented baffles that define a flow pathway. The geometry and longitudinal spacing of the single segmented baffles may be properly selected depending on the desired flow rate, a desired flow volume of fluid, a desired heat output, and a desired efficiency, for example, through the flow pathway of the respective heat exchanger assembly 16.

Figure 10:
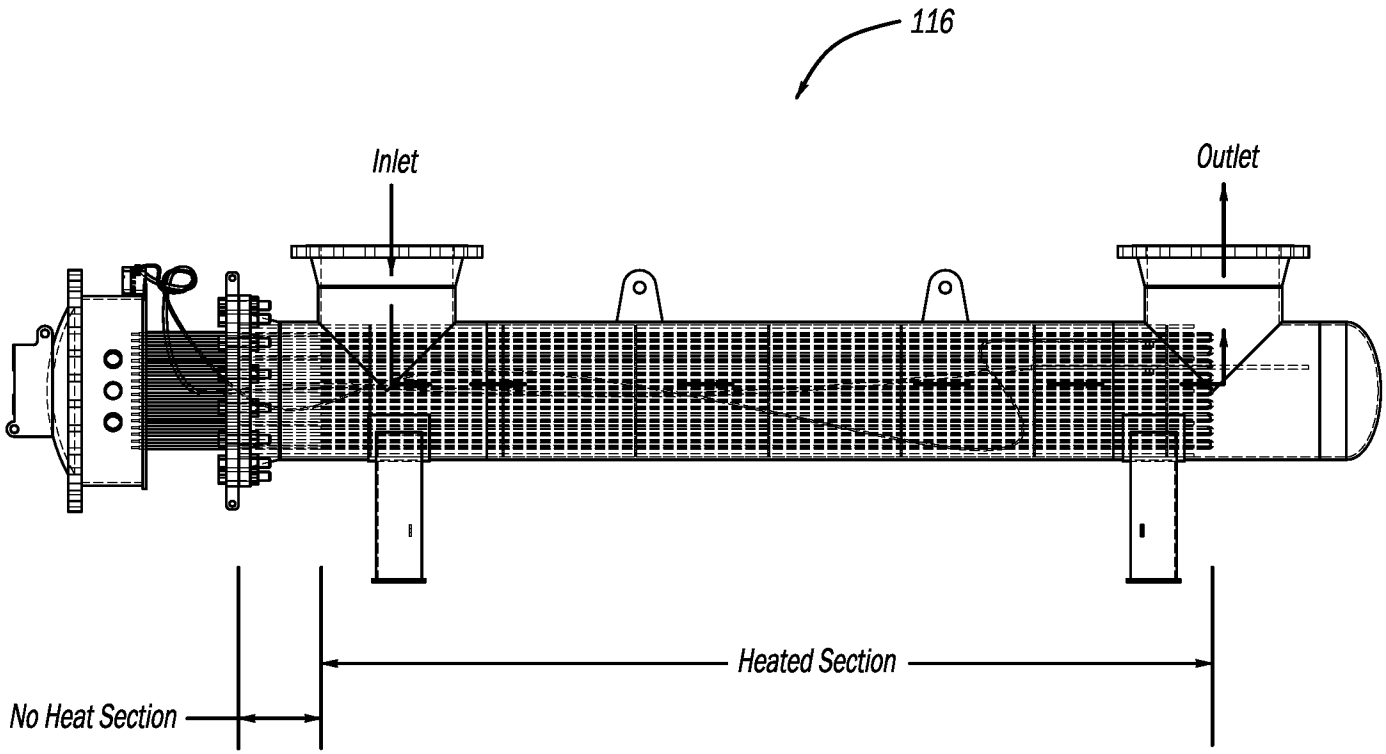
FIG. 10 is a side view of one form of a heat exchanger assembly that is configured to be incorporated into the electric heater system of FIG. 8.
Figure 11:
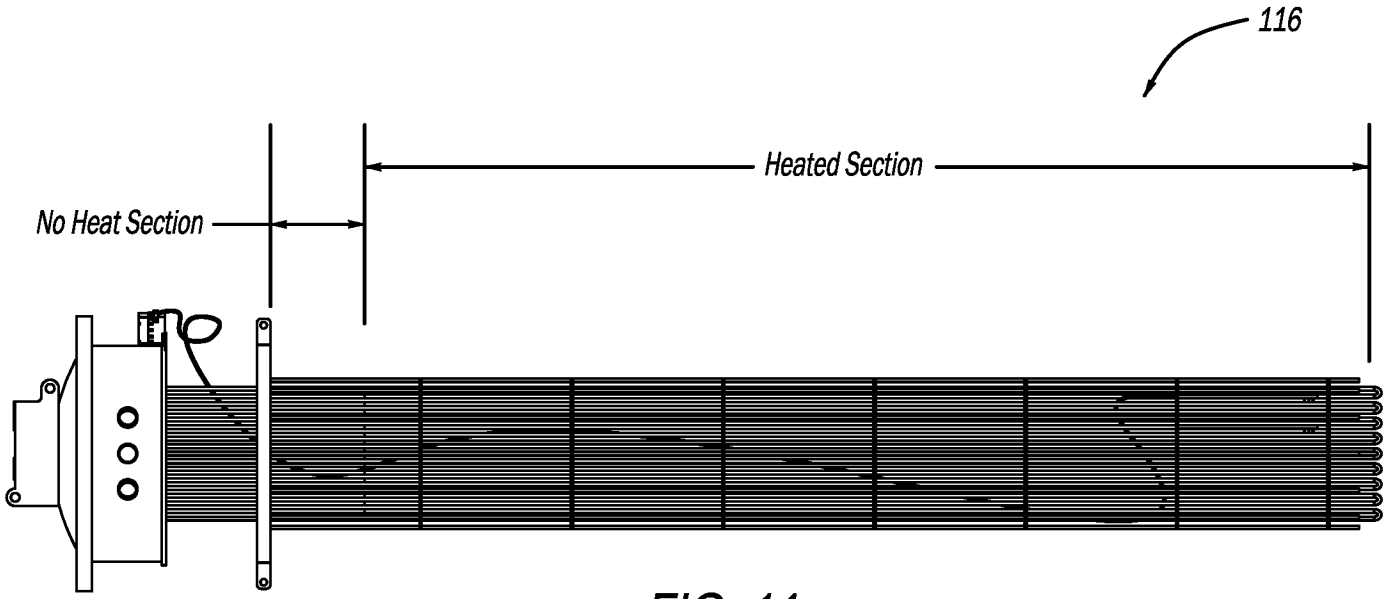
FIG. 11 is a side view of the heat exchanger assembly of FIG. 10 with a vessel removed for further clarity.
Figure 12:
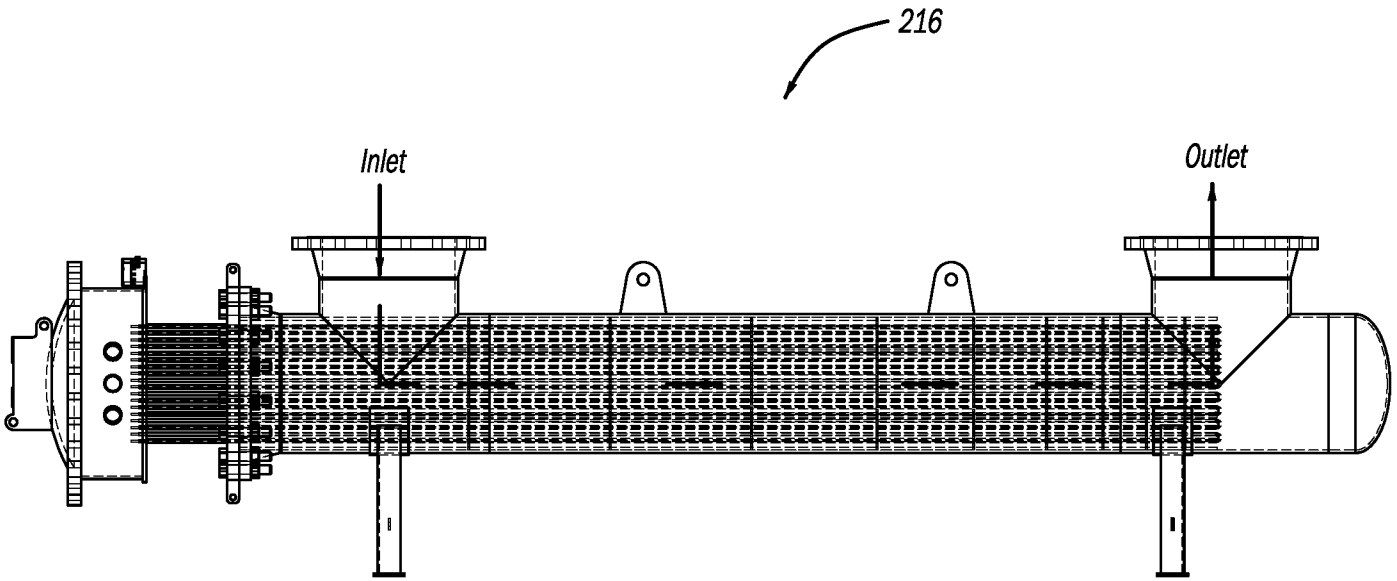
FIG. 12 is a side view of yet another form of a heat exchanger assembly that is configured to be incorporated into the electric heater system of FIG. 8.
Figure 13:
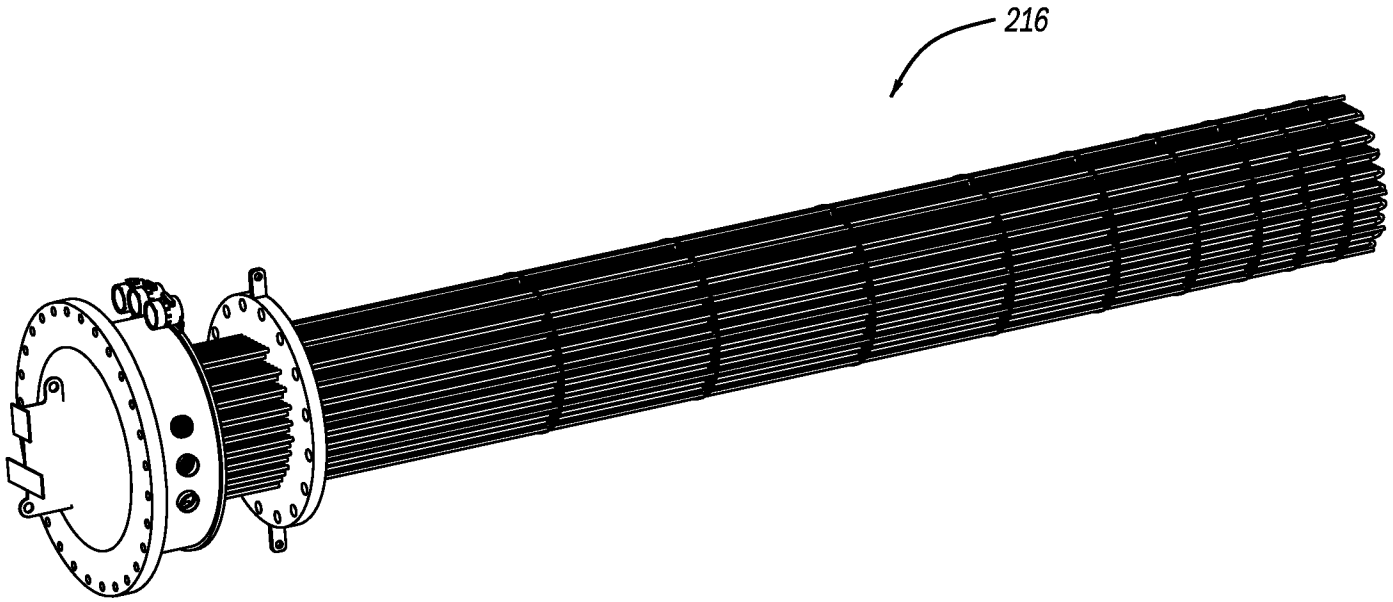
FIG. 13 is a perspective view of the heat exchanger assembly of FIG. 12 with a vessel removed for further clarity.
Figure 14:
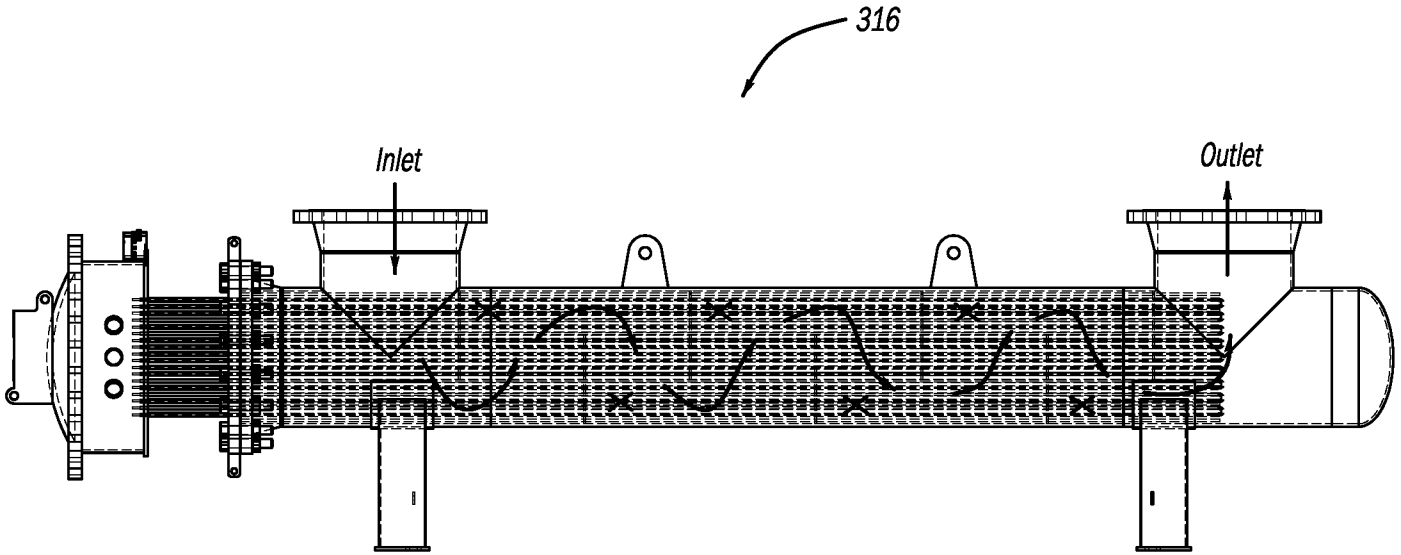
FIG. 14 is a side view of yet another form of a heat exchanger assembly that is configured to be incorporated into the electric heater system of FIG. 8.
Figure 15:
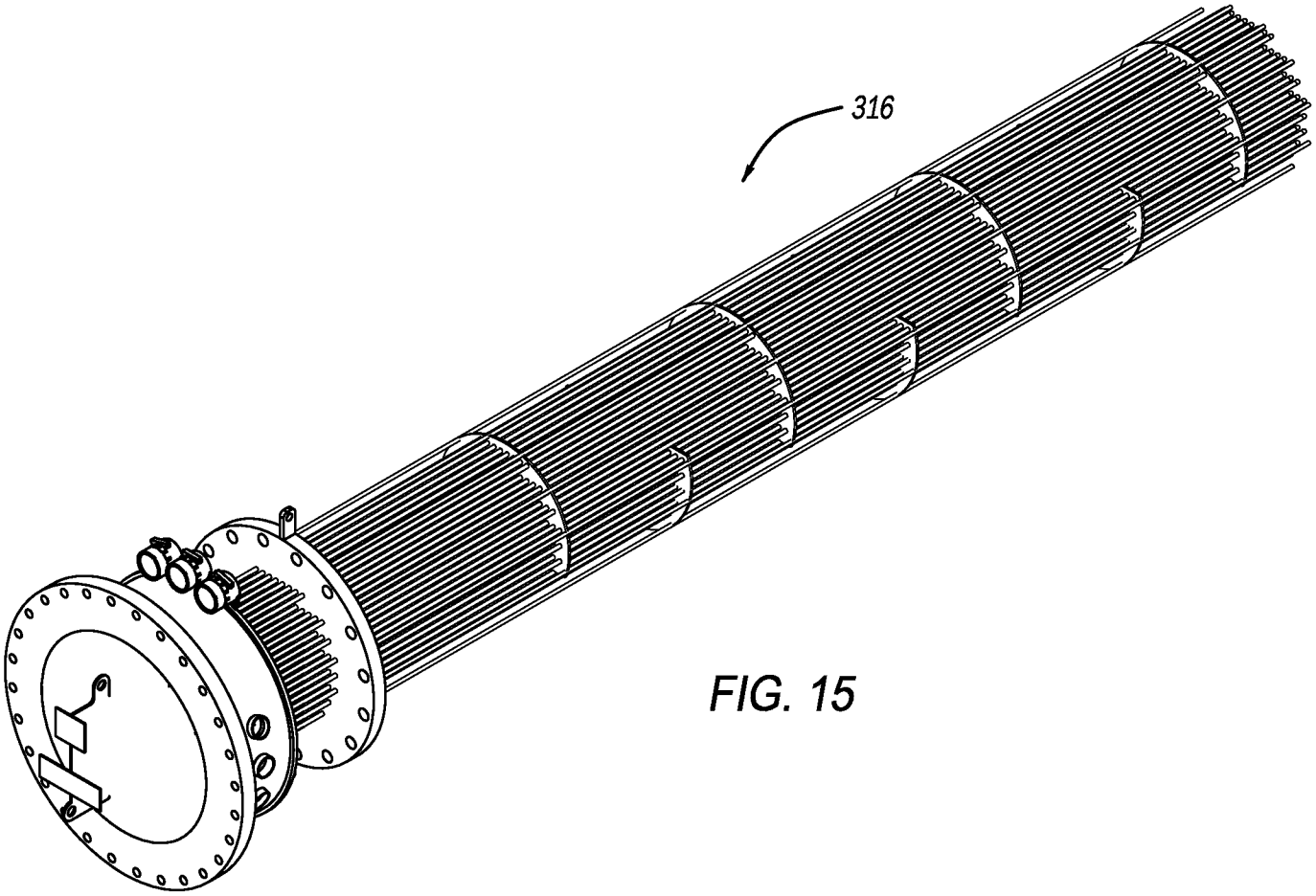
FIG. 15 is a perspective view of the heat exchanger assembly of FIG. 14 with a vessel removed for further clarity.
Figure 16:
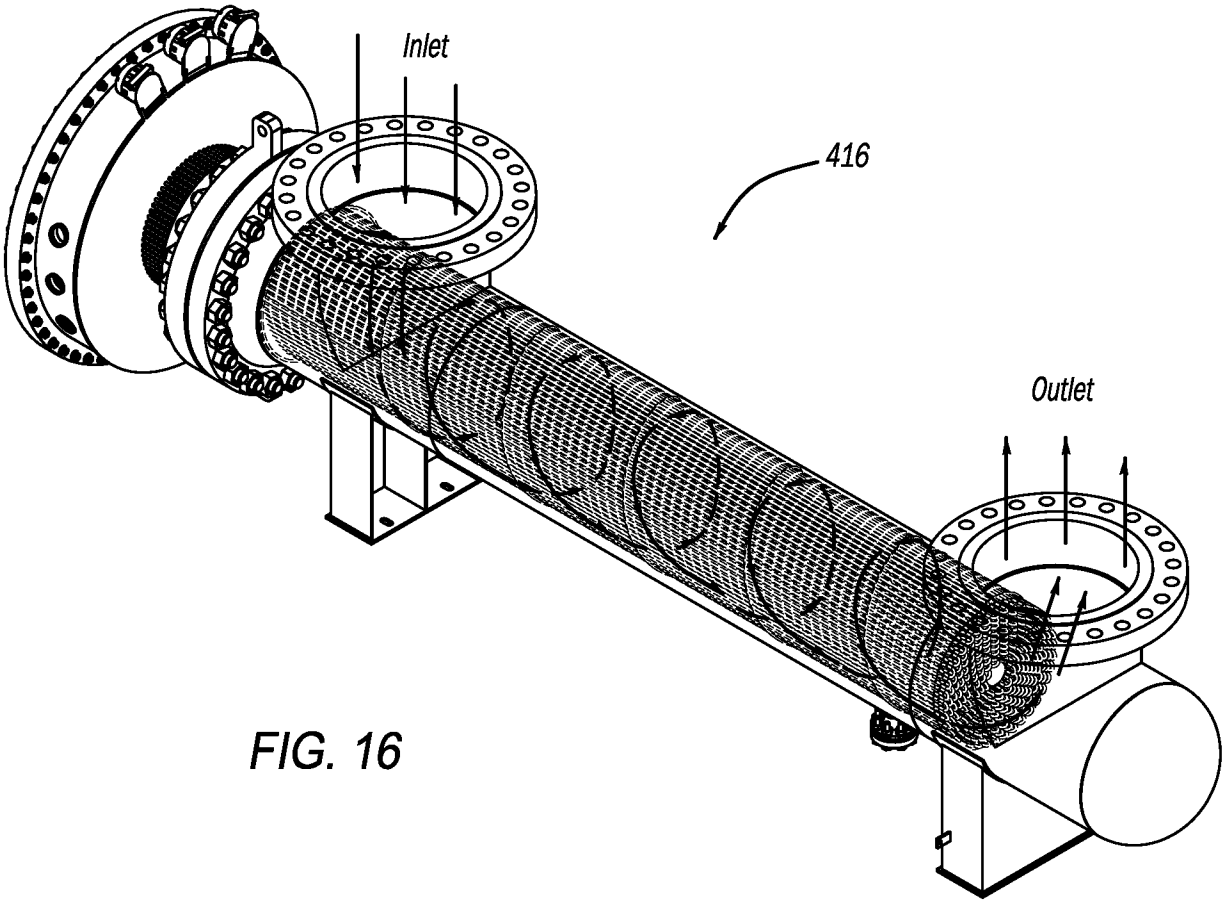
FIG. 16 is a perspective view of yet another form of a heat exchanger assembly that is configured to be incorporated into the electric heater system of FIG. 1.
Figure 17:
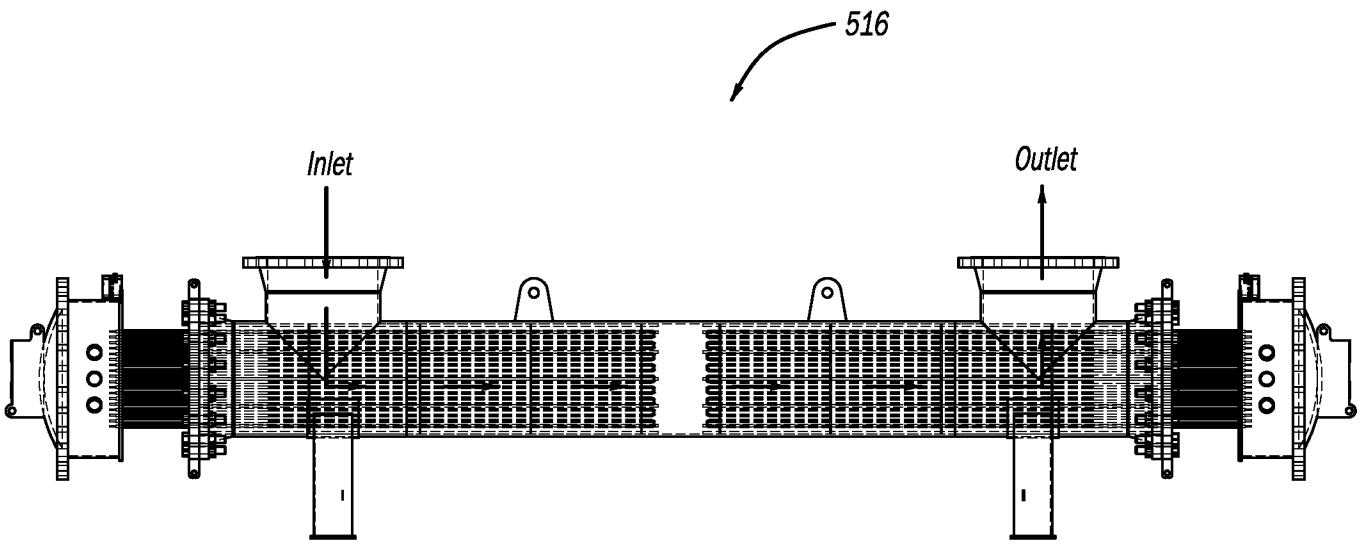
FIG. 17 is a side view of two electric heaters arranged adjacent to each other in a single vessel.

With reference to FIGS. 10-17, alternate heat exchanger assemblies are provided that can be incorporated into the electric heater system 10. For example, as shown in FIGS. 10 and 11, heat exchanger assembly 116 is provided where fluid enters an inlet of a vessel, flows through equally spaced baffles located at the heated section, and exits an outlet of the vessel. In another example, as shown in FIGS. 12 and 13, heat exchanger assembly 216 is provided where fluid enters an inlet of a vessel, flows through baffles located at the heated section, and exits an outlet of the vessel. The baffles of heat exchanger assembly 216 are positioned and strategically spaced apart to improve heat transfer to the fluid flowing through the vessel. In yet another example, as shown in FIGS. 14 and 15, heat exchanger assembly 316 is provided where fluid enters an inlet of a vessel, flows through a fluid pathway defined by segmented baffles located at the heated section, and exits an outlet of the vessel. The baffles of heat exchanger assembly 316 are positioned to increase the velocity of the fluid flowing through the fluid pathway, which improves heat transfer to the fluid flowing through the vessel. In the example shown in FIG. 16, heat exchanger assembly 416 is provided where fluid enters an inlet of a vessel, flows through a fluid pathway defined by a continuous helical-shaped baffle located at the heated section, and exits an outlet of the vessel. The baffle of heat exchanger assembly 416 is positioned to reduce the flow area of the fluid flowing through the fluid pathway, which increases the velocity of the fluid flowing through the fluid pathway. The swirling flow pattern improves heat transfer and uniformity which reduces hot spots in the fluid pathway. In the example shown in FIG. 17, heat exchanger assembly 516 is provided where fluid enters an inlet of a vessel, flows through a first fluid pathway defined by first baffles of a first heater bundle and a second fluid pathway defined by second baffles of an adjacent second heater bundle, and subsequently exits an outlet of the vessel. The first and second baffles may be disposed within the same vessel and may be of the same or different types.

Further structural details of fluid heat exchangers that may be included in the electric heater system 10 are disclosed in U.S. Pat. Nos. 6,944,394, 6,392,206 and U.S. Publication 2021/0136876, which are commonly owned with the present application and the contents of which are incorporated herein by reference in their entirety.

A first heat exchanger assembly 16 of the plurality of heat exchanger assemblies 16 connected in series may include a first fluid guide member 27 that is of a different type or the same type than a second fluid guide member of a second heat exchanger assembly 16 of the plurality of heat exchanger assemblies 16. For example, the first fluid guide member 27 may be of a continuous helical shape and the second fluid guide member 27 may be of single segmented baffles. In this way, the desired velocity and desired heat output may be properly selected for each heat exchanger assembly 16 to obtain the desired pressure drop between the inlet 12 and the outlet 14, which produces a two-phase mixture in annular flow regime and improves the vaporization at the process fluid temperature.

As best seen in FIGS. 2, 3, and 5-7, the connectors 18 secure the vessels 21 of the plurality of heat exchanger assemblies 16 to each other and are also in fluid communication with the vessels 21. The connectors 18 shown in the figures are straight. However, in some examples, the connectors 18 may include a bend and may be connected to ends of the vessels 21. An insulating shroud 36 may surround the heat exchanger assemblies 16 and the connectors 18.

It should be understood that the resistive heaters 29 may be removed for cleaning and maintenance purposes from a respective heat exchanger assembly 16 without interfering with the other heat exchanger assemblies 16.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An electric heater system comprising:

an inlet;

an outlet;

a plurality of heat exchanger assemblies connected in series, each heat exchanger assembly comprising a vessel, heating elements disposed within the vessel, and at least one fluid guide member; and one or more connectors securing the vessels of the plurality of heat exchanger assemblies to each other, the one or more connectors also in fluid communication with the vessels, wherein fluid entering the inlet flows through the heat exchanger assemblies and through the one or more connectors and exits through the outlet, the fluid guide members of the heat exchanger assemblies being of different combinations to generate a predetermined pressure drop between the inlet and the outlet, wherein a first heat exchanger assembly of the plurality of heat exchanger assemblies includes a first fluid guide member and a second heat exchanger assembly of the plurality of heat exchanger assemblies includes a second fluid guide member, the first and second fluid guide members are of different types.

2. The electric heater system according to claim 1, wherein the first and second fluid guide members are adjacent to each other.

3. The electric heater system according to claim 2, wherein the first fluid guide member comprises a helical-shaped baffle, and wherein the second fluid guide member comprises single segmented baffles.

4. The electric heater system according to claim 1, wherein a third heat exchanger assembly of the plurality of heat exchanger assemblies includes a third fluid guide member, the first and second heat exchanger assemblies are adjacent to each other and two of the first, second, and third fluid guide members are of a same type.

5. The electric heater system according to claim 4, wherein the first and second fluid guide members comprises a helical-shaped baffle and the third fluid guide member comprises single segmented baffles.

6. The electric heater system according to claim 1, further comprising an insulating shroud surrounding the plurality of heat exchanger assemblies and the connectors.

7. The electric heater system according to claim 1, wherein each heat exchanger assembly includes a heated section and a non-heated section, the heating elements disposed within the heated section and the non-heated section disposed between the heated section and an electrical enclosure.

8. The electric heater system according to claim 1, wherein each heat exchanger assembly includes an electrical component configured to operate the heating elements, and wherein at least two of the electrical components have different operating voltages.

9. The electric heater system according to claim 1, wherein a single electrical component is configured to operate all the heating elements of the plurality of heat exchanger assemblies at a same operating voltage.

10. The electric heater system according to claim 1, wherein the connectors are straight or bent.

11. The electric heater system according to claim 1, wherein the predetermined pressure drop is equal to or greater than 30%.

12. The electric heater system according to claim 1, wherein the plurality of heat exchanger assemblies include:

a first row of heat exchanger assemblies, each heat exchanger assembly in the first row includes a first electrical component configured to operate the heating elements;

a second row of heat exchanger assemblies, each heat exchanger assembly in the second row includes a second electrical component configured to operate the heating elements; and a third row of heat exchanger assemblies, each heat exchanger assembly in the third row includes a third electrical component configured to operate the heating elements, wherein the first, second and third electrical components have different operating voltages.

13. An electric heater system comprising:

an inlet;

an outlet;

a plurality of heat exchanger assemblies connected in series, each heat exchanger assembly comprising a vessel, heating elements disposed within the vessel, and at least one fluid guide member;

a plurality of electrical components configured to operate the heating elements of the plurality of heat exchanger assemblies; and one or more connectors securing the vessels of the plurality of heat exchanger assemblies to each other, the one or more connectors also in fluid communication with the vessels;

wherein fluid entering the inlet flows through the heat exchanger assemblies and through the one or more connectors and exits through the outlet, the fluid guide members of the heat exchanger assemblies being of different combinations to generate a predetermined pressure drop between the inlet and the outlet, and wherein a first heat exchanger assembly of the plurality of heat exchanger assemblies includes a first fluid guide member and an adjacent second heat exchanger assembly of the plurality of heat exchanger assemblies includes a second fluid guide member, the first and second fluid guide members are of different types.

14. The electric heater system according to claim 13, wherein the connectors are straight or bent.

15. The electric heater system according to claim 13, wherein the predetermined pressure drop is equal to or greater than 30%.

16. The electric heater system according to claim 13, wherein the plurality of heat exchanger assemblies include:

a first row of heat exchanger assemblies, each heat exchanger assembly in the first row includes a first electrical component of the plurality of electrical components configured to operate the heating elements;

a second row of heat exchanger assemblies, each heat exchanger assembly in the second row includes a second electrical component of the plurality of electrical components configured to operate the heating elements; and a third row of heat exchanger assemblies, each heat exchanger assembly in the third row includes a third electrical component of the plurality of electrical components configured to operate the heating elements, wherein the first, second and third electrical components have different operating voltages.

17. The electric heater system according to claim 13, further comprising an insulating shroud surrounding the plurality of heat exchanger assemblies and the connectors.

18. An electric heater system comprising:

an inlet;

an outlet;

a plurality of heat exchanger assemblies connected in series, each heat exchanger assembly comprising a vessel, heating elements disposed within the vessel, and at least one fluid guide member;

one or more connectors securing the vessels of the plurality of heat exchanger assemblies to each other, the one or more connectors also in fluid communication with the vessels; and an insulating shroud surrounding the plurality of heat exchanger assemblies and the connectors;

wherein fluid entering the inlet flows through the heat exchanger assemblies and through the one or more connectors and exits through the outlet, the fluid guide members of the heat exchanger assemblies being of different combinations to generate a predetermined pressure drop between the inlet and the outlet, wherein a first heat exchanger assembly of the plurality of heat exchanger assemblies includes a first fluid guide member and an adjacent second heat exchanger assembly of the plurality of heat exchanger assemblies includes a second fluid guide member, the first and second fluid guide members are of different types, and wherein each heat exchanger assembly includes an electrical component configured to operate the heating elements, and wherein at least two of the electrical components have different operating voltages.

* * * * *